US009163384B2

(12) United States Patent
Stratton et al.

(10) Patent No.: US 9,163,384 B2
(45) Date of Patent: Oct. 20, 2015

(54) SYSTEM AND METHOD FOR DETECTING A CREST

(71) Applicant: Caterpillar Inc., Peoria, IL (US)

(72) Inventors: Kenneth L. Stratton, Dunlap, IL (US); Troy K. Becicka, Sahuarita, AZ (US); Michael Taylor, Swissvale, PA (US); Thandava K. Edara, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/252,297

(22) Filed: Apr. 14, 2014

(65) Prior Publication Data

US 2014/0229079 A1 Aug. 14, 2014

Related U.S. Application Data

(63) Continuation of application No. 13/561,788, filed on Jul. 30, 2012, now Pat. No. 8,700,272.

(51) Int. Cl.

| | |
|---|---|
| ***E02F 9/20*** | (2006.01) |
| ***E02F 9/24*** | (2006.01) |
| ***E02F 3/84*** | (2006.01) |

(52) U.S. Cl.

CPC ..... *E02F 9/2025* (2013.01); *E02F 3/84* (2013.01); *E02F 3/841* (2013.01); *E02F 9/2029* (2013.01); *E02F 9/24* (2013.01)

(58) Field of Classification Search

CPC ..... E02F 3/84; E02F 3/841; E02F 9/24; E02F 9/2025; E02F 9/2029

USPC ..... 701/23, 26, 33.9, 50; 172/103, 260.5, 172/261, 399; 175/4.5, 45, 399

See application file for complete search history.

(56) References Cited

U.S. PATENT DOCUMENTS

| | | | | |
|---|---|---|---|---|
| 5,610,815 | A * | 3/1997 | Gudat et al. | 701/23 |
| 5,704,200 | A * | 1/1998 | Chmielewski et al. | 56/10.2 E |
| 5,950,141 | A | 9/1999 | Yamamoto et al. | |
| 6,493,612 | B1 | 12/2002 | Bisset et al. | |
| 6,984,952 | B2 | 1/2006 | Peless et al. | |
| 7,516,563 | B2 * | 4/2009 | Koch | 37/348 |
| 7,607,494 | B2 | 10/2009 | Alft et al. | |
| 7,734,397 | B2 | 6/2010 | Peterson et al. | |
| 7,881,497 | B2 | 2/2011 | Ganguli et al. | |
| 7,917,265 | B2 * | 3/2011 | Kale et al. | 701/50 |
| 7,979,172 | B2 * | 7/2011 | Breed | 701/23 |
| 8,103,418 | B2 * | 1/2012 | Osswald et al. | 701/50 |
| 2002/0005297 | A1 | 1/2002 | Alft et al. | |
| 2003/0111268 | A1 | 6/2003 | Alft et al. | |
| 2004/0158355 | A1 * | 8/2004 | Holmqvist et al. | 700/245 |
| 2004/0190374 | A1 | 9/2004 | Alft et al. | |
| 2004/0207247 | A1 | 10/2004 | Jackson et al. | |
| 2005/0132618 | A1 * | 6/2005 | Koch | 37/348 |

(Continued)

FOREIGN PATENT DOCUMENTS

JP 2000-137522 A 5/2000

*Primary Examiner* — Mary Cheung
*Assistant Examiner* — Atul Trivedi
(74) *Attorney, Agent, or Firm* — Leydig, Voit & Mayer, Ltd.

(57) ABSTRACT

A system for automated control of a machine having a ground engaging work implement includes an implement load sensor system. A controller determines a change in terrain based at least in part upon a change in the load on the ground engaging work implement. If the change in terrain exceeds a threshold, the controller generates an alert command signal. A method is also provided.

20 Claims, 3 Drawing Sheets

(56) References Cited

U.S. PATENT DOCUMENTS

| | | | | |
|---|---|---|---|---|
| 2005/0173153 | A1 | 8/2005 | Alft et al. | |
| 2005/0177292 | A1 | 8/2005 | Okamura et al. | |
| 2006/0089764 | A1* | 4/2006 | Filippov et al. | 701/23 |
| 2006/0089765 | A1* | 4/2006 | Pack et al. | 701/23 |
| 2006/0089766 | A1* | 4/2006 | Allard et al. | 701/23 |
| 2007/0240903 | A1 | 10/2007 | Alft et al. | |
| 2008/0091309 | A1* | 4/2008 | Walker | 701/1 |
| 2008/0161986 | A1* | 7/2008 | Breed | 701/23 |
| 2008/0257570 | A1* | 10/2008 | Keplinger et al. | 172/9 |
| 2009/0043462 | A1* | 2/2009 | Stratton et al. | 701/50 |
| 2009/0090555 | A1 | 4/2009 | Boone et al. | |
| 2009/0159302 | A1* | 6/2009 | Koch et al. | 172/2 |
| 2010/0052684 | A1* | 3/2010 | Fling et al. | 324/326 |
| 2010/0109417 | A1 | 5/2010 | Jackson et al. | |
| 2011/0153214 | A1* | 6/2011 | Sprock et al. | 702/5 |
| 2011/0231069 | A1* | 9/2011 | Ryder et al. | 701/50 |
| 2012/0004816 | A1 | 1/2012 | Okamura et al. | |

* cited by examiner

SYSTEM AND METHOD FOR DETECTING A CREST

CROSS-REFERENCE TO RELATED APPLICATION

This patent application is a continuation of U.S. patent application Ser. No. 13/561,788 entitled System and Method for Detecting a Crest, filed Jul. 30, 2012, now U.S. Pat. No. 8,700,272, which is hereby incorporated by reference in its entirety.

TECHNICAL FIELD

This disclosure relates generally to controlling a machine, and more particularly, to a system and method for automated control of the machine adjacent a crest.

BACKGROUND

Autonomous or semi-autonomous movement of mechanisms and machines is increasingly desirable for many operations including those related to mining, earthmoving and other industrial activities. Autonomously operated machines may remain consistently productive without regard to a human operator or environmental conditions. In addition, autonomous systems may permit operation in environments that are unsuitable or undesirable for a human operator. Autonomous or semi-autonomous systems may also compensate for inexperienced human operators as well as inefficiencies associated with repetitive tasks.

Maps with designated paths and boundaries may be set for such autonomously and semi-autonomously operated machines. At a site in which a machine may operate in proximity to a crest such as a ridge, embankment, high wall or other change in elevation or sloped area, remaining within the designated boundaries becomes especially critical. Systems that typically monitor and control autonomously or semi-autonomously operated machines may include global positioning systems or systems that determine position based upon the revolutions of the tires or other driven components of the machine. While such systems are capable of determining the position of a machine relative to a map, they do not account for changes that occur to the terrain after the map has been developed.

U.S. Pat. No. 7,881,497 discloses a system for controlling an autonomous vehicle through a vision based navigation and guidance system. The system uses a camera to detect images and applies such images to an edge detection circuit. The edge detection information is used with navigation information that may be provided from various types of systems including inertial movement, global positioning, stereo vision, radar, mapping and the like.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a system for automated control of a machine having a ground engaging work implement includes an implement load sensor system. The implement load sensor system is configured to measure a load on the ground engaging work implement and provide an implement load signal indicative of the load on the ground engaging work implement. A controller is configured to receive the implement load signal and determine a change in terrain based at least in part upon a change in the load on the ground engaging work implement. The controller determines whether the change in terrain exceeds a threshold change in terrain and generates an alert command signal if the change in terrain exceeds the threshold change in terrain.

In another aspect, a method of detecting a change in terrain includes providing a machine having a ground engaging work implement and providing an implement load sensor system configured to measure a load on the ground engaging work implement. The implement load signal is received and a change in terrain is determined based at least in part upon the load on the ground engaging work implement. A determination is made as to whether the change in terrain exceeds a threshold change in terrain and an alert command signal is generated if the change in terrain exceeds the threshold change in terrain.

In still another aspect, a machine includes a prime mover, a ground engaging work implement, and an implement load sensor system. The implement load sensor system is configured to measure a load on the ground engaging work implement and provide an implement load signal indicative of the load on the ground engaging work implement to a controller. The controller is configured to receive the implement load signal and determine a change in terrain based at least in part upon a change in the load on the ground engaging work implement. The controller determines whether the change in terrain exceeds a threshold change in terrain and generates an alert command signal if the change in terrain exceeds the threshold change in terrain.

DETAILED DESCRIPTION

Figure 1:
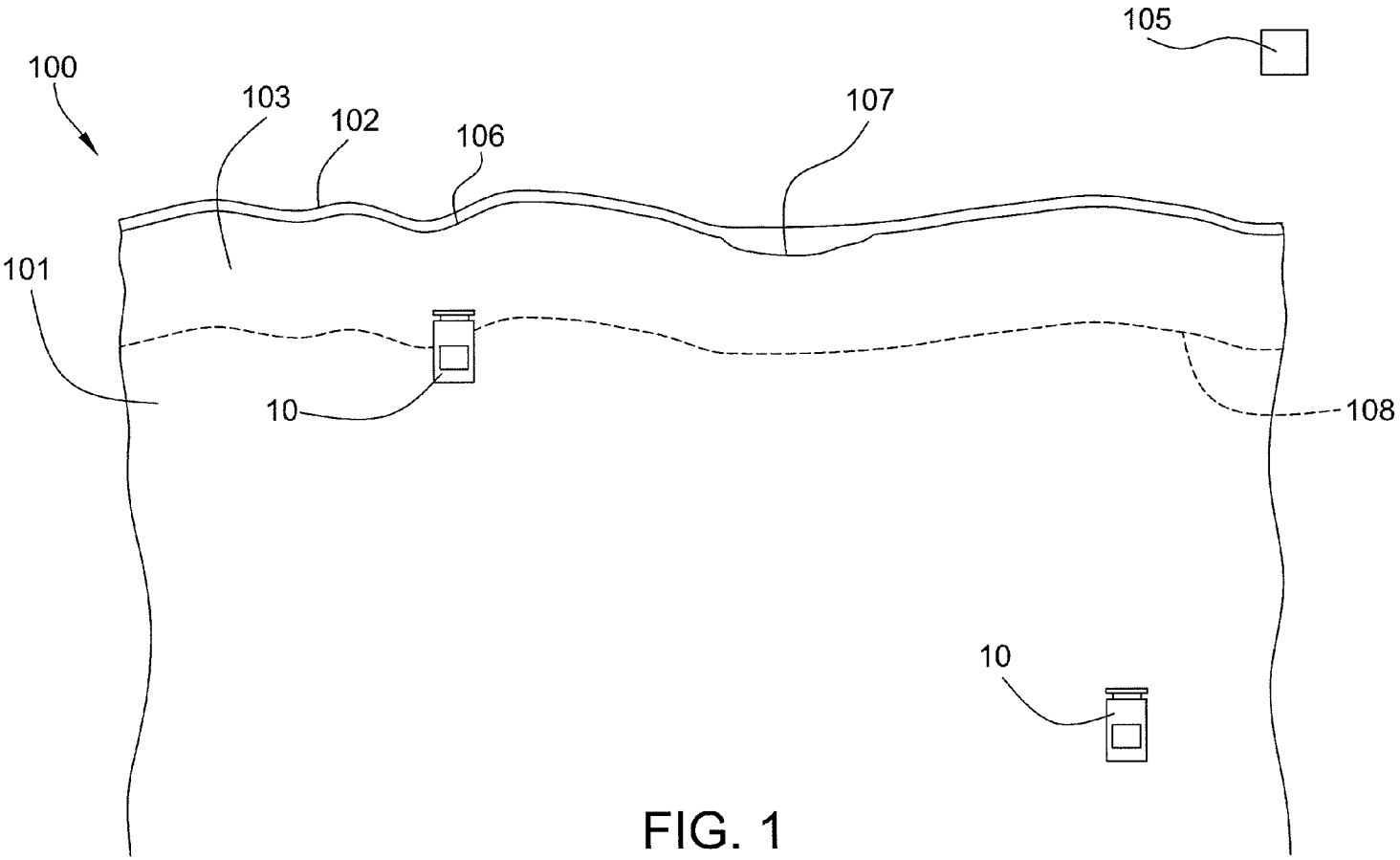
FIG. 1 shows a schematic view of a work site at which a machine incorporating the principles disclosed herein may be used.

FIG. 1 depicts a diagrammatic illustration of a work site 100 at which one or more machines 10 may operate in an autonomous, a semi-autonomous, or manual manner. Work site 100 may be a portion of a mining site, a construction site or any other area in which movement of machine 10 is desired. As depicted, work site 100 includes a work area 101 having a crest 102 defining an edge of a ridge, embankment, high wall or other change in elevation. The crest 102 may take any of a number of different forms at which a change in terrain occurs and may include various straight and curved sections as depicted in FIG. 1.

As used herein, a machine 10 operating in an autonomous manner operates automatically based upon information received from various sensors without the need for human operator input. As an example, a haul truck that automatically follows a path from one location to another and dumps a load at an end point may be operating autonomously. A machine operating semi-autonomously includes an operator, either within the machine or remotely, who performs some tasks or provides some input and other tasks are performed automatically and may be based upon information received from various sensors. As an example, a truck that automatically follows a path from one location to another but relies upon an operator command to dump a load may be operating semi-autonomously. In another example of a semi-autonomous operation, an operator may dump a bucket of an excavator in a load truck and a controller may automatically return the bucket to a position to perform another digging operation. A machine being operated manually is one in which an operator is controlling all or essentially all of the functions of the machine. A machine may be operated remotely by an operator (i.e., remote control) in either a manual or semi-autonomous manner.

Figure 2:
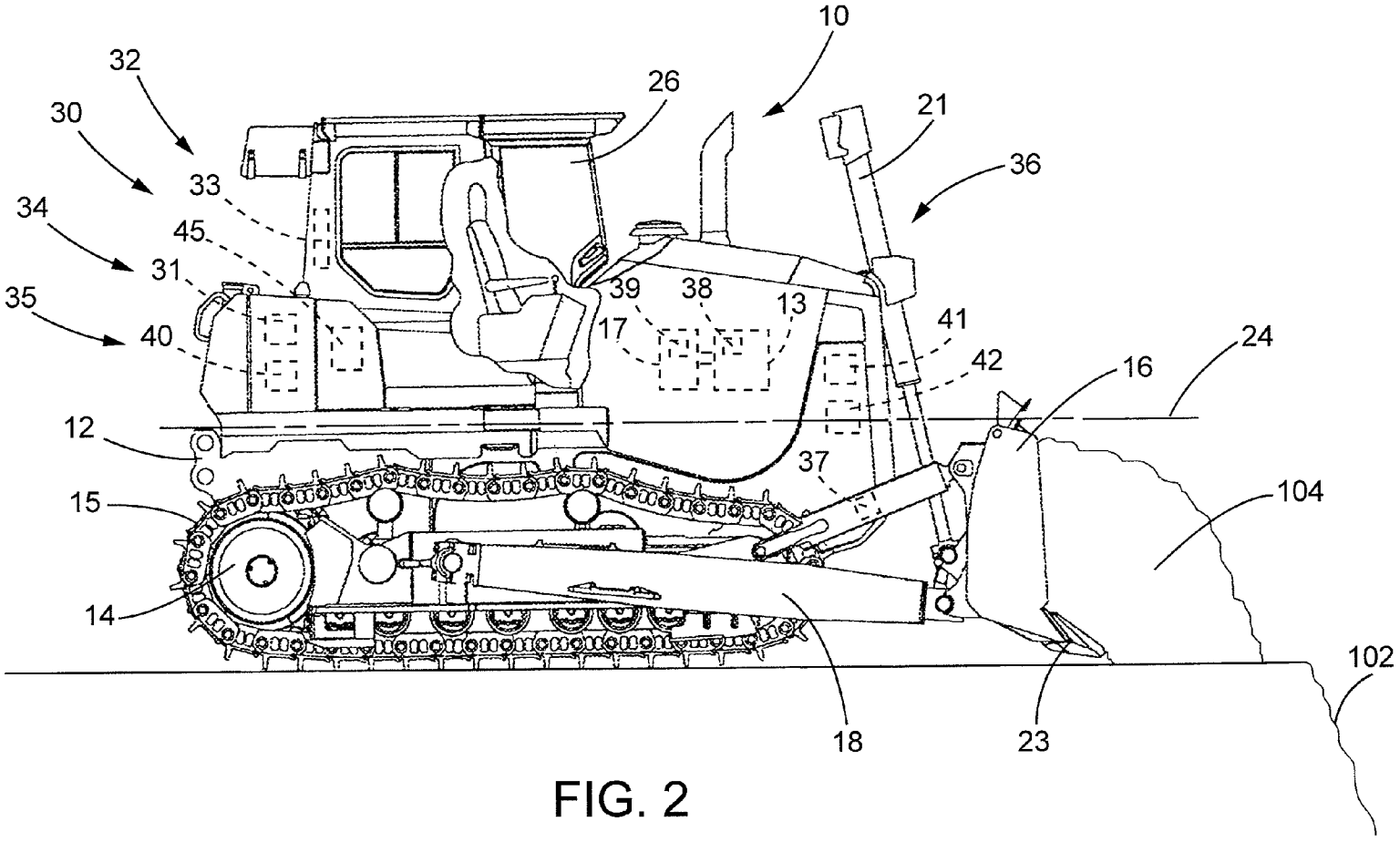
FIG. 2 shows a diagrammatic illustration of a machine in accordance with the disclosure.

FIG. 2 shows a diagrammatic illustration of a machine 10 such as a dozer adjacent crest 102 with a blade 16 pushing material 104 over the crest. The machine 10 includes a frame 12 and a prime mover such as an engine 13. A ground-engaging drive mechanism such as a track 15 is driven by a drive wheel 14 on each side of machine 10 to propel the machine 10. Although machine 10 is shown in a "track-type" configuration, other configurations, such as a wheeled configuration, may be used.

The systems and methods of the disclosure may be used with any machine propulsion and drivetrain mechanisms applicable in the art including hydrostatic, electric, or a mechanical drive. As depicted in FIG. 2, machine 10 may be configured with a type of mechanical drive system so that engine 13 drives a torque converter 17 which in turn drives a transmission (not shown). The transmission may be operatively connected to the drive wheels 14 and the tracks 15. Operation of the engine 13 and transmission, and thus the drive wheels 14 and tracks 15, may be controlled by a control system 30 including a controller 31. Other types of prime movers and drive systems are contemplated.

Machine 10 may include a ground engaging work implement such as blade 16 pivotally connected to frame 12 by arms 18 on each side of machine 10. First hydraulic cylinder 21 coupled to frame 12 supports blade 16 in the vertical direction, and allows blade 16 to move up or down vertically from the point of view of FIG. 2. Second hydraulic cylinders 22 on each side of machine 10 allow the pitch angle of blade tip 23 to change relative to a centerline 24 of the machine.

Machine 10 may be equipped with a plurality of sensors that provide data indicative (directly or indirectly) of various operating parameters of the machine. The hydraulic system may include sensors for monitoring pressure within the system as well as the pressure of specific cylinders. For example, one or both of the second hydraulic cylinders 22 may include an associated pressure sensor 37. Sensors may be provided to monitor the operating conditions of the engine 13 and drivetrain such as an engine speed sensor 38 and a torque converter speed sensor 39. The machine may also include an accelerometer 40 for determining the acceleration of the machine along various axes. Still further, a pitch angle sensor 41 and a pitch rate sensor 42 may be included for determining roll, pitch and yaw of machine 10. Other sensors necessary or desirable for operating the machine 10 may be provided.

Machine 10 may have a control system 30 that interacts with a positioning system such as a global positioning system ("GPS") to control the movement of the machine about the work site 100. In addition, a network system such as wireless network system 105 may provide generalized commands to the control system 30 that the control system utilizes to generate specific commands to operate the various systems of machine 10. In the alternative, the wireless network system 105 may provide some or all of the specific commands that are then transmitted by the control system 30 to the systems of the machine 10. Machine 10 may be one of several machines operating at work site 100.

Rather than operating the machine 10 in an autonomous manner, an operator may have the ability to operate the machine 10 remotely such as with a wireless control unit 45. Still further, machine 10 may also include a cab 26 that an operator may physically occupy and provide input to control the machine. Cab 26 may include one or more input devices through which the operator issues commands to control the propulsion and steering of the machine as well as operate various implements associated with the machine. In one embodiment, machine 10 may be configured to be operated autonomously, semi-autonomously, or manually. In case of semi-autonomous or manual operation, the machine may be operated by remote control and/or by an operator physically located within the cab 26.

The control system 30, as shown generally by an arrow in FIG. 2 indicating association with the machine 10, may include an electronic control module or controller 31. The controller 31 may receive input command signals from the wireless network system 105, remote control input command signals from an operator operating machine 10 remotely or operator input command signals from an operator operating the machine 10 from within cab 26. The controller 31 may control the operation of the drivetrain as well as the hydraulic systems that operate the ground engaging work implement such as blade 16. The control system 30 may include one or more sensors to provide data and other input signals representative of various operating parameters of the machine 10. The term "sensor" is meant to be used in its broadest sense to include one or more sensors and related components that may be associated with the machine 10 and that may cooperate to sense various functions, operations, and operating characteristics of the machine.

The controller 31 may be an electronic controller that operates in a logical fashion to perform operations, execute control algorithms, store and retrieve data and other desired operations. The controller 31 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller such as power supply circuitry, signal conditioning circuitry, driver circuitry, and other types of circuitry.

The controller 31 may be a single controller or may include more than one controller disposed to control various functions and/or features of the machine 10. The term "controller" is meant to be used in its broadest sense to include one or more controllers and/or microprocessors that may be associated with the machine 10 and that may cooperate in controlling various functions and operations of the machine. The functionality of the controller 31 may be implemented in hardware and/or software without regard to the functionality. The controller 31 may rely on one or more data maps relating to the operating conditions of the machine 10 that may be stored in the memory of controller. Each of these maps may include a collection of data in the form of tables, graphs, and/or equations.

A position sensing system 32, as shown generally by an arrow in FIG. 2 indicating association with the machine 10, may include a position sensor system 33 to sense a position of the machine relative to the work area 101. The position sensor system 33 may include a plurality of individual sensors that cooperate to provide signals to controller 31 to indicate the position of the machine 10. The controller 31 may determine the position of the machine 10 within work area 101 as well as the orientation of the machine such as the heading, pitch and roll. In doing so, the dimensions of the machine 10 may be stored within the controller 31 with the position sensor system defining a datum or reference point on the machine and the controller using the dimensions to determine the outer boundary of the machine. Such position sensor system 33 may be a series of GPS sensors, an odometer or other wheel rotation sensing sensor, a perception based system or may use other systems such as lasers to determine the position of machine 10.

Although crest 102 may define the edge of a ridge, embankment, high wall or other change in elevation or sloped area, an electronic map of the crest 102 referred to herein as the boundary of operation or outer boundary 106 of the work area 101 as established within controller 31 or remotely in a system associated with the wireless network system 105 may vary from the actual crest position. In the example depicted in FIG. 1, outer boundary 106 generally follows and is slightly inside of crest 102 along most of its length. At section 107, however, the outer boundary is depicted as varying substantially from the crest 102. Variations between the physical crest 102 and the stored outer boundary 106 may be due to material that has been moved without a corresponding update of the outer boundary 106 such as by material moved by another machine, due to shifting of the material or otherwise. Still further, errors may occur while setting, storing, transmitting or changing the outer boundary 106 within a computer system. In other words, for a variety of reasons, the outer boundary 106 of the work area 101 stored within or remotely from the controller 31 may be different from the actual physical location of crest 102.

Work area 101 may include a crest zone 103 that extends a predetermined width or distance from the crest 102 into the work area 101. The crest zone 103 may be used as a buffer or zone in which additional measures or processes may be used to reduce the likelihood that machines 10 will move closer to crest 102 than desired. The width of the crest zone 103 may be fixed for a particular work site 100, a particular work area 101 or may even change along the crest 102. Factors that influence the width of the crest zone 103 may include the height and angle of the slope adjacent the crest 102, environmental conditions in which the machine 10 is being operated as well as the type of material at the work area 101. As described in more detail below, a process may be used once the machine 10 enters the crest zone 103 to determine whether the machine has encountered a change in terrain such as that adjacent crest 102 and automatically reverse the movement of the machine away from the crest.

In one example, the outer boundary 106 may be mapped or determined and the crest zone 103 calculated as extending a predetermined width or distance from the outer boundary 106. The edge of the crest zone 103 may be defined by a crest zone boundary 108 that may generally follow the outer boundary 106. As a result, each of the outer boundary 106 and the crest zone boundary 108 may define a path or reference that is representative of or approximates the position of the crest 102.

In view of the possible differences between the actual crest 102 and the electronic map of outer boundary 106, it may be desirable to utilize an additional or secondary system, in addition to the position sensing system 32, when operating machine 10 near a crest 102 to reduce the likelihood that the machine 10 will unintentionally be moved closer to crest 102 than desired. Such an additional system may be particularly useful when operating the machine 10 in an autonomous or semi-autonomous manner but may also be useful when operating the machine manually such as by remote control or with an operator located in the cab 26.

The control system 30 may include an additional system such as a crest detection system 34 shown generally by an arrow in FIG. 2 indicating association with the machine 10. One type of crest detection system 34 that may be used to sense the crest 102 may be an implement load monitoring system 35 shown generally by an arrow in FIG. 2. The implement load monitoring system 35 may include a variety of different types of implement load sensors depicted generally by an arrow in FIG. 2 as an implement load sensor system 36 to measure the load on the ground engaging work implement or blade 16. As blade 16 of machine 10 moves material 104 over the crest 102 as depicted in FIG. 2, the load on the blade will be reduced. Accordingly, the implement load sensor system 36 may be utilized to measure or monitor the load on the blade 16 and a decrease in load may be registered by the controller 31 as a change in terrain due to the machine 10 being adjacent the crest 102. In other words, the controller 31 may determine a change in terrain based at least in part upon a change in the load on blade 16.

In one embodiment, the implement load sensor system 36 may embody one or more pressure sensors 37 for use with hydraulic cylinder, such as second hydraulic cylinders 22, associated with blade 16. Signals from the pressure sensor 37 indicative of the pressure within the second hydraulic cylinders 22 may be monitored by controller 31. Upon receipt of a signal indicating a substantial reduction in pressure within the second hydraulic cylinders 22, the controller 31 may determine that the load on blade 16 has been substantially reduced due to the material 104 having been pushed over crest 102. Other manners of determining a reduction in cylinder pressure associated with a reduction in the load on blade 16 are contemplated, including other manners of measuring the pressure within second hydraulic cylinders 22 and measuring the pressure within other cylinders associated with the blade.

In another embodiment, the implement load sensor system 36 may embody sensors for measuring a difference between output from the engine 13 and the output from the torque converter 17. More specifically, an engine speed sensor 38 may be utilized to generate a signal indicative of the speed or output of the engine 13. A torque converter speed sensor 39 may be utilized to monitor the output speed of the torque converter 17. During an operation such as moving material with blade 16, the engine output speed indicated by engine speed sensor 38 and the torque converter output speed indicated by torque converter speed sensor 39 may be relatively constant. Upon moving material 104 over the crest 102 with blade 16, the load on the blade will be substantially reduced and thus cause a change in the relative speeds between the engine 13 and the torque converter 17. Accordingly, by monitoring the difference between the engine speed and the torque converter speed, a reduction in load on the blade may be determined indicative of the material 104 having been pushed over crest 102.

Other manners of measuring differences between prime mover output and other components within the propulsion and drivetrain mechanisms that are reflective of a change in load on the implement are also contemplated. Still further, in alternate embodiments in which the machine propulsion and drivetrain mechanisms are hydrostatic or electric, the implement load sensor system may embody other sensors that detect a difference between output from the prime mover and other aspects of the propulsion and drivetrain mechanisms that may be used by the controller 31 to detect a reduction in load on the blade 16.

In still another embodiment, implement load sensor system 36 may embody an acceleration sensor such as a three-axis accelerometer 40 for providing an acceleration signal indicative of measured acceleration of the machine 10. Upon moving a load of material 104 past the crest 102, the machine 10 may accelerate due to the reduction in load on the blade 16. Controller 31 may utilize such acceleration of the machine 10 to determine that the machine has reached crest 102. When using accelerometer 40 to determine proximity to the crest 102, it may be desirable to also use a pitch rate sensor (e.g., a gyroscope) 42 to provide a pitch rate signal indicative of a pitch rate of the machine 10. The controller 31 may utilize an acceleration signal provided by the accelerometer 40 together with the pitch rate signal provided by the pitch rate sensor 42 to determine the acceleration of the machine 10 along the ground or generally parallel to centerline 24 of the machine. If desired, filtering techniques may be used to reduce the noise associated with the acceleration signal from the accelerometer 40. Other manners of determining the acceleration of machine 10 are also contemplated. In some circumstances, it may desirable to determine the velocity of the machine 10 and then differentiate the velocity to determine the acceleration of the machine.

Through the use of an implement load sensor system 36, controller 31 is able to determine from a change in load on blade 16 that machine 10 is adjacent the crest 102. As a result, even if the controller 31 has not determined that the machine 10 is adjacent the crest 102 based upon the position sensor system 33 and the map of the outer boundary 106, the controller 31 may issue an alert command and may reverse the machine away from crest 102.

The load on the implement may be affected by the slope of the terrain upon which the machine 10 is moving. Accordingly, if desired, the accuracy of the implement load measurement may be increased by utilizing the implement load sensor system 36 in conjunction with a slope or inclination sensor such as pitch angle sensor 41. For example, if the machine 10 is moving uphill, the load on the blade may be higher due to gravity as compared to a machine operating in the same conditions on flat terrain. Similarly, the load on the blade 16 may be lower for the same conditions when operating the machine in a downhill orientation. By determining the slope of the terrain, the controller 31 may more accurately determine changes in the load on the blade 16.

In addition to the implement load monitoring systems 35 described above, other crest detection systems 34 may be used either alone or in combination with more than one crest detection system. One such crest detection system may use other sensors as change of terrain sensors for determining a change in terrain or proximity of machine 10 to crest 102. In one example, a pitch angle as indicated by a pitch angle sensor 41 that exceeds a threshold pitch angle or is outside of an expected range of pitch angles may indicate that the machine 10 is adjacent the crest 102. In another example, a change in pitch rate as indicated by a pitch rate sensor 42 that exceeds a threshold rate or is outside an expected rate may indicate that the machine 10 is adjacent the crest 102. Still further, additional systems and sensors may be used to determine a change in terrain or proximity of machine 10 to crest 102. For example, perception sensors for use with systems such as vision, laser, radar or sonar systems may also be used to detect the physical location of crest 102. Machine 10 may incorporate any or all of the crest detection systems disclosed herein and may incorporate other systems that perform similar functions, if desired.

The control system 30 and its associated sensors may be configured to operate the machine 10 in an autonomous manner, in a semi-autonomous manner, by remote control, or with an operator in the cab 26. As stated above, there may be situations in which the outer boundary 106 stored within or remotely from controller 31 does not accurately reflect the actual boundary of the crest 102. Accordingly, rather than relying on the position sensing system 32 to determine whether the machine 10 has actually reached the crest 102, additional sensors may be provided to determine whether the machine has reached the crest. The controller 31 and such additional sensors may operate as a crest detection system 34 to provide additional safety when operating machine 10 autonomously or semi-autonomously with respect to movement and positioning of the machine. The crest detection system 34 may also be used in other situations, if desired, such as when an operator is operating the machine remotely or when an operator is in the cab 26.

Figure 3:
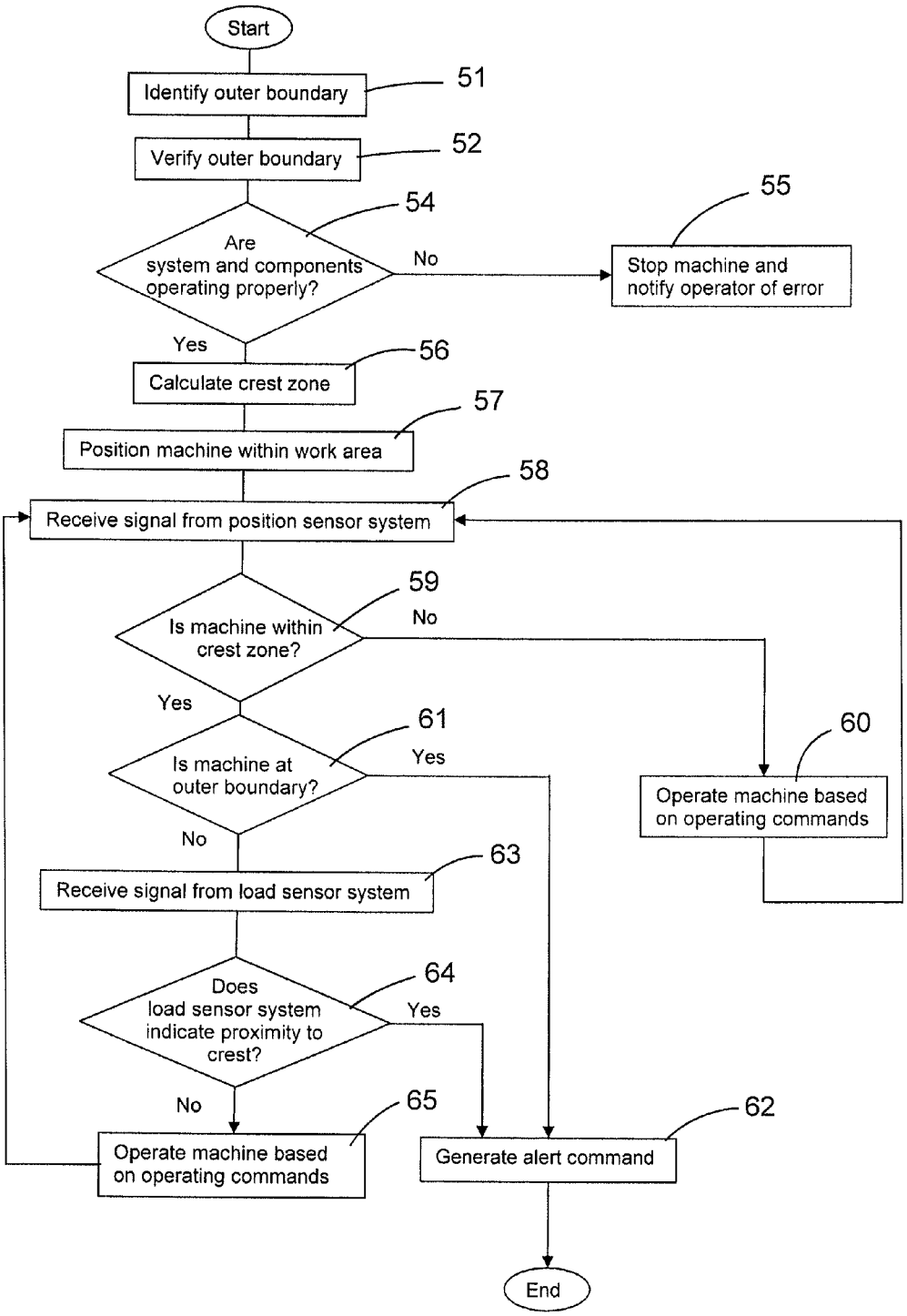
FIG. 3 shows a flowchart illustrating a crest detection process in accordance with the disclosure.

Referring to FIG. 3, a flow chart depicting a process that may be used with the implement load monitoring system 35 for automated detection of the crest 102 along a work area 101 is depicted. At stage 51, the outer boundary 106 of the work area 101 is determined. The outer boundary 106 may be determined by a topographical map of the earth at the work site 100. In an alternate step, the outer boundary 106 may be determined by moving a mapping vehicle along the crest 102 to establish the outer boundary. Once the outer boundary 106 has been generated, the outer boundary may be displayed on an output device such as a display screen and verified by the operator at stage 52.

After the control system 30 has been initialized, the controller 31 may also conduct various tests to confirm that the system and the components of machine 10 are operating properly at decision stage 54. If any of the system or components of machine 10 are not operating properly, the controller 31 may stop the machine 10 and notify the operator of an error at stage 55.

If the control system 30 and components of machine 10 are operating properly at decision stage 54, the controller 31 may calculate the crest zone 103 at stage 56. The crest zone 103 may be a predetermined distance from outer boundary 106. The width of the crest zone 103 or the distance the crest zone boundary 108 extends from the outer boundary 106 may be established for the entire work site 100, for a particular work area 101 or for a portion of the work area. The width of the crest zone 103 may be set based upon the risks associated with operation near the crest 102 such as the height and angle of the slope adjacent the crest, the environmental conditions in which the machine 10 is operating as well as the type of material upon which the machine 10 is operating or moving. In one example, the width of the crest zone 103 may be 1-2 times the length of the machine 10. In other examples, the width of the crest zone may be between 10-40 feet.

After the outer boundary 106 and the crest zone 103 have been set, the machine 10 may be positioned and operate within work area 101 at stage 57. The controller 31 receives at stage 58 position signals from the position sensor system 33 indicative of the position of the machine within the work area 101. At decision stage 59, the controller 31 determines whether the machine 10 is in the crest zone 103 based upon the position signal received from the position sensor system 33. If the machine 10 is not within the crest zone 103, the machine 10 is operated at stage 60 based upon instructions from the controller 31 and/or the wireless network system 105. During such operation, the machine 10 may include various automated safeguards in case the machine encounters certain operating conditions or movements that exceed predetermined thresholds. For example, the controller 31 may monitor the pitch angle of the machine 10 based upon signals received from the pitch angle sensor 41. If the pitch angle of the machine 10 exceeds a predetermined threshold, the controller may generate an alert command which may include stopping operation of the machine. If the pitch angle is less than the predetermined threshold, the machine 10 may be operated in accordance with the operating commands that have been generated. The predetermined thresholds may be stored within data maps of the controller 31.

If the machine 10 is within the crest zone 103 at decision stage 59, the controller 31 determines at decision stage 61 whether the machine is at the outer boundary 106. If the machine 10 has reached the outer boundary 106 (e.g., the blade 16 of the machine 10 has reached the outer boundary), the controller 31 may generate an alert command signal which may include a reverse command signal at stage 62 to reverse the machine.

If the machine 10 is within the crest zone 103 at decision stage 61 but has not reached the outer boundary 106, the controller 31 receives at stage 63 a signal from the implement load sensor system 36. At decision stage 64, the controller 31 determines whether the signal from the implement load sensor system 36 indicates that a reduction in load on the implement has occurred sufficient to indicate proximity of the machine 10 to the crest 102. In doing so, the controller 31 may compare the implement load signal received from the implement load sensor system 36 to a data map of implement load signals and associated operating characteristics within the controller to determine whether a change in terrain has occurred. The controller 31 may determine whether the change in terrain determined based upon the change in load on the ground engaging work implement exceeds a predetermined threshold. In an alternate configuration, the controller 31 may determine whether the change in terrain is within an expected range. If the implement load sensor system 36 indicates that the machine 10 is in proximity to the crest 102, the controller 31 may generate an alert command signal, which may include a reverse command signal, and the machine 10 may be reversed at stage 62. If the load sensor does not indicate that the machine is in proximity to the crest 102, the machine 10 is operated at stage 65 based upon instructions from the controller 31 and/or the wireless network system 105.

Industrial Applicability

The industrial applicability of the control system 30 described herein will be readily appreciated from the forgoing discussion. The foregoing discussion is applicable to machines 10 that include a ground engaging work implement for moving material 104 adjacent to a crest. In one example, the machine 10 may be a dozer including a blade 16 for moving material 104 along the ground. The machine 10 may operate in an autonomous, semi-autonomous or manual manner to move material at a work site 100, such as a mining site, from a first position to a second position over a crest 102.

As the machine 10 moves, the controller 31 may monitor various systems and operating conditions of the machine. The controller 31 may include a first data map (such as that indicative of a load on the blade 16) against which the operating data or characteristics of the machine 10 is compared when operating within the work area 101 but outside the crest zone 103. A second data map may be compared to the operating data or characteristics of the machine when the machine 10 is operating within the crest zone 103. Through such a configuration, the control system 30 may monitor the operating data of the machine 10 relatively closely while the machine is within the crest zone 103 without unduly limiting or slowing the operation of the machine when it is outside of the crest zone and thus a significant distance from the crest 102.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for automated control of a machine having a ground engaging work implement for moving material along a work surface, comprising:

an implement load sensor system configured to measure a load on the ground engaging work implement indicative of an amount of material being moved by the ground engaging work implement along the work surface and provide to a controller an implement load signal based upon the amount of material being moved by the ground engaging work implement;

the controller configured to:

store a threshold change in the implement load signal, the threshold change in the implement load signal being indicative of proximity to a crest;

receive the implement load signal;

determine a change in the implement load signal;

determine whether the change in the implement load signal exceeds the threshold change in the implement load signal; and generate an alert command signal if the change in the implement load signal exceeds the threshold change in the implement load signal.

2. The system of claim 1, wherein the controller is further configured to store a work area for the machine including a crest zone adjacent the crest, the alert command signal is a reverse command signal, and the controller only generates the reverse command signal while the machine is operating within the crest zone.

3. The system of claim 2, further including a position sensing system to provide a signal indicative of a position of the machine and the controller is configured to determine whether the machine is within the crest zone.

4. The system of claim 2, wherein the controller is configured to store a data map of implement load signals and associated operating characteristics for use while the machine is operating within the crest zone, and compare the implement load signal to the data map of implement load signals while the machine is within the crest zone to determine the change in the implement load signal.

5. The system of claim 1, further including a machine pitch angle sensor, and the controller determines the proximity to a change in elevation of the work surface at least in part based upon a signal from the machine pitch angle sensor.

6. The system of claim 1, wherein the alert command signal is a reverse command signal.

7. The system of claim 1, wherein the implement load sensor system includes a sensor for monitoring a difference between output from a prime mover and output from a torque converter, and the controller determines the change in the implement load signal based at least in part upon a change in the difference between the output from the prime mover and the output from the torque converter.

8. The system of claim 1, wherein the implement load sensor system includes a pressure sensor for monitoring pressure within a hydraulic cylinder operatively connected to the ground engaging work implement, and the controller determines the change in the implement load signal based at least in part upon a change in pressure within the hydraulic cylinder.

9. The system of claim 1, wherein the implement load sensor system includes an acceleration sensor for monitoring acceleration of the machine, and the controller determines the change in the implement load signal based at least in part upon acceleration of the machine.

10. The system of claim 1, wherein the controller is further configured to determine proximity to a change in elevation of the work surface based at least in part upon the change in the implement load signal.

11. A controller implemented method of detecting proximity to a crest, comprising:

providing a machine having a ground engaging work implement for moving material along a work surface;

providing an implement load signal based upon a load on the ground engaging work implement;

storing a threshold change in the implement load signal, the threshold change in the implement load signal being indicative of proximity to a crest;

receiving the implement load signal;

determining a change in the implement load signal;

determining whether the change in the implement load signal exceeds a threshold change in the implement load signal; and generating an alert command signal if the change in the implement load signal exceeds the threshold change in the implement load signal.

12. The controller implemented method of claim 11, wherein the alert command signal is a reverse command signal.

13. The controller implemented method of claim 11, wherein the implement load sensor system includes a sensor for monitoring a difference between output from a prime mover and output from a torque converter, and further including determining the change in the implement load signal based at least in part upon a change in the difference between the output from the prime mover and the output from the torque converter.

14. The controller implemented method of claim 11, wherein the implement load sensor system includes a pressure sensor for monitoring pressure within a hydraulic cylinder operatively connected to the ground engaging work implement, and further including determining the change in the implement load signal based at least in part upon a change in pressure within the hydraulic cylinder.

15. The controller implemented method of claim 11, wherein the implement load sensor system includes an acceleration sensor for monitoring acceleration of the machine and further including determining the change in the implement load signal based at least in part upon acceleration of the machine.

16. The controller implemented method of claim 11, further including storing a work area for the machine including a crest zone adjacent a crest, and determining whether the machine is operating within the crest zone and only generating a reverse command signal as part of the alert command signal if the machine is operating within the crest zone.

17. The controller implemented method of claim 11, further including a pitch angle sensor, and receiving a signal from the pitch angle sensor indicative of the pitch angle of the machine and determining proximity to a change in elevation of the work surface at least in part based upon the pitch angle of the machine.

18. The controller implement method of claim 11, further including determining proximity to a change in elevation of the work surface based at least in part upon the change in the implement load signal.

19. A machine comprising:

a prime mover;

a blade for moving material along a work surface;

an implement load sensor system configured to measure a load on the blade indicative of an amount of material being moved by the blade along the work surface and provide to a controller an implement load signal based upon the amount of material being moved by the blade; and the controller configured to:

store a threshold change in implement load signal, the threshold change in implement load signal being indicative of proximity to a crest;

receive the implement load signal;

determine a change in the implement load signal;

determine whether the change in the implement load signal exceeds the threshold change in the implement load signal; and generate an alert command signal if the change in the implement load signal exceeds the threshold change in the implement load signal.

20. The machine of claim 19, wherein the controller is further configured to determine proximity to a change in elevation of the work surface based at least in part upon the change in the implement load signal.

* * * * *